US005546615A

United States Patent [19]

Chamness

[11] Patent Number: 5,546,615

[45] Date of Patent: Aug. 20, 1996

[54] METHOD AND DEVICE FOR PROVIDING AN INSULATED COVER OVER A POOL

[75] Inventor: Gary M. Chamness, Blairsburg, Iowa

[73] Assignee: Waste Management & Design, Inc., Webster, Iowa

[21] Appl. No.: 337,867

[22] Filed: Nov. 14, 1994

[51] Int. Cl.[6] ..... E04H 4/10

[52] U.S. Cl. ..... 4/503; 4/498

[58] Field of Search ..... 4/498, 503, 506

[56] References Cited

U.S. PATENT DOCUMENTS

| | | | |
|---|---|---|---|
| 2,952,024 | 9/1960 | Bartolucci | 4/503 |
| 2,958,872 | 11/1960 | Meyer, Jr. | 4/503 |
| 4,094,021 | 6/1978 | Rapp | 4/498 |
| 4,197,595 | 4/1980 | Dearing | 4/503 |
| 5,067,182 | 11/1991 | Koelsch | 4/498 |
| 5,400,549 | 3/1995 | Morgan | 4/498 X |

FOREIGN PATENT DOCUMENTS

| | | | |
|---|---|---|---|
| 2004656 | 8/1971 | Germany | 4/498 |

*Primary Examiner*—Robert M. Fetsuga
*Attorney, Agent, or Firm*—Zarley, McKee, Thomte, Voorhees & Sease

[57] ABSTRACT

An insulated cover for a pool includes a plurality of panels joined in edge to edge relation with one another to form a panel assembly for covering the surface of the pool. Each of the panels includes an upper and a lower sheet member joined together at their edges so as to form a flat surface around the perimeter of the panel and a pocket within the center of the panel. An insulating member is fitted within the pocket between the two sheet members. Panel tie members join the various panels together in edge to edge relation and a plurality of anchor tie members join the edges of the panel assembly to a plurality of anchors around the perimeter of the pool or lagoon.

10 Claims, 3 Drawing Sheets

METHOD AND DEVICE FOR PROVIDING AN INSULATED COVER OVER A POOL

BACKGROUND OF THE INVENTION

The present invention relates to a method and device for providing an insulated cover over a pool.

There are numerous applications for providing an insulated cover over a pool. For example, insulated covers have been used over swimming pools to maintain the temperature of the pool over night or during cool seasons. Another example of insulated covers relates to lagoons or pools which are used for digesting sludge and other contaminates for waste materials. In these lagoons it is desirable to provide a cover over the lagoon so as to maintain an appropriate temperature within the lagoon to enable bacteria to decompose the materials in solution in the lagoon.

Therefore a primary object of the present invention is the provision of an improved method and device for providing an insulated cover over a pool or lagoon.

A further object of the present invention is the provision of an insulated cover which can be comprised of various modular parts.

A further object of the present invention is the provision of an improved insulated cover which can by virtue of its modular parts be formed into a number of different shapes to accommodate different shapes of lagoons or pools.

A further object of the present invention is the provision of an improved insulated cover which can be quickly and easily assembled and which is sturdy in construction after assembling.

A further object of the present invention is the provision of an improved insulating cover which resists corrosion and other chemical reactions resulting from contact with the elements and with the materials within the lagoon or pool.

A further object of the present invention is the provision of an improved insulated cover for pools which is economical to manufacture, durable in use, and efficient in operation.

SUMMARY OF THE INVENTION

The foregoing objects may be achieved by an insulated cover for a pool having a pool perimeter, a pool bottom, and a quantity of fluid contained within the pool. The cover includes a plurality of panels having perimetric panel edges. Each of the panels include first and second sheet members super imposed over one another with their edges joined together to create a pocket therebetween. An insulative material is enclosed within the pocket. A plurality of panel tie members join the plurality of panels together in edge to edge relation so as to create a panel assembly having a perimetric assembly edge. A plurality of anchors are positioned around the pool, and a plurality of anchor tie members are each connected to the perimetric assembly edge of the panel assembly and to one of the anchors so as to secure the panel assembly in covering relation over the fluid within the pool.

In one variation of the invention a plurality of elongated plastic members made of corrosion and acid resistant material extend along and retentively engage the assembly edge of the panel assembly. In this embodiment the anchor tie members are attached to the elongated plastic members and to the anchors so as to secure the insulated cover in place.

Another variation of the present invention includes a plurality of grommets mounted in spaced relation to one another along the perimetric assembly edge. The elongated plastic members may be mounted extending through at least some of the grommets.

In another variation of the present invention a plurality of anchor tie members can be mounted through the grommets and tied to the anchors.

According to the method of the present invention, the plurality of insulated panels are joined together in edge to edge relationship to form the panel assembly. The various panels are joined together by a plurality of panel tie members which secure the adjacent edges of the insulated panels together. A plurality of anchor tie members are then connected to the perimetric edge of the panel assembly and the panel assembly is placed in covering relation over the pool. Then the anchor tie members are connected to a plurality of anchors positioned around the pool perimeter.

Figure 4:
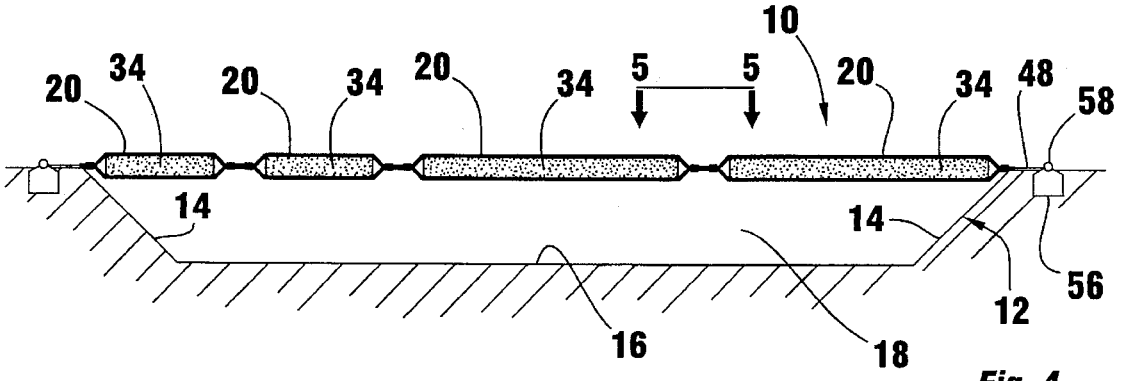
FIG. 4 is a sectional view taken along line 4—4 of FIG. 1.

Referring to the drawings, an insulated cover 10 is shown positioned over a pool or lagoon 12 (FIG. 4). Lagoon 12 includes side walls 14 and a bottom 16. A fluid 18 is contained within the lagoon 12. While lagoon 12 is shown to be a digestive lagoon for sewage, it can also be a swimming pool or other type of pool where it is desirable to maintain the temperature of the fluid within the pool.

Figure 3:
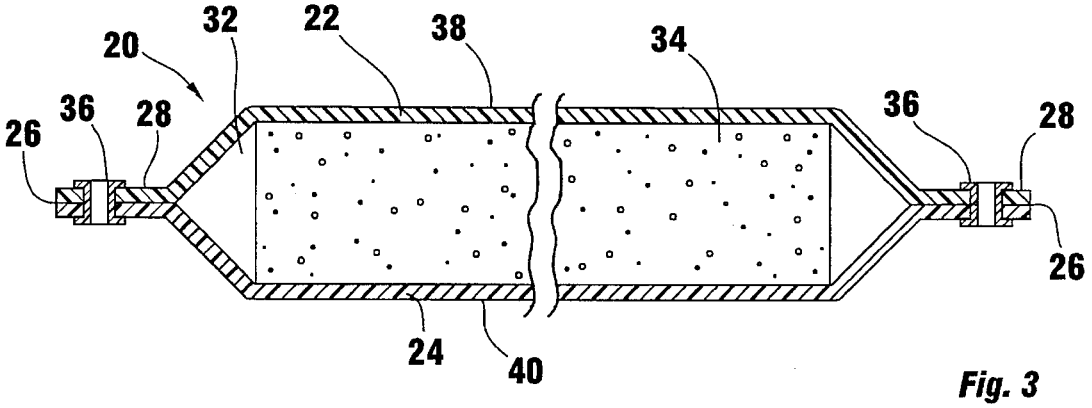
FIG. 3 is a sectional view taken along line 3—3 of FIG. 2.

The panel assembly 10 is comprised of a plurality of panels 20 which are joined together in edge to edge relationship to form the panel assembly 10. Each panel includes an upper sheet member 22 and a lower sheet member 24 (FIG. 3). The perimetric edges of the sheet members 22, 24 are joined together by a heat seal so as to be fuse welded together and so as to form flattened side edges 28 and flattened end edges 30 around the perimeter of the panel 20. Between the sheet members 24, 26 is a pocket or envelope 32 containing an insulative material which is preferably polystyrene so as to resist corrosion or decomposition. Extending around the flattened side and end edges 28, 30 are a plurality of grommets 36. As can be seen in FIG. 3 the panel includes a raised central top surface 38 and a raised bottom surface 40 caused by the thickness of the insulative material 34. While the dimensions and R-value of the panel 20 can be varied without detracting from the invention, the preferred dimension would be for panels which are 7½ feet×40 feet and which are 2⅝ inches thick. This will produce an R-value of 10. The sheet members 22, 24 are formed from a 30 mil HDPE plastic material which is acid and corrosion resistant. This material is quite strong and is easily fused adjacent the edges of the sheet members 22, 24.

Figure 5:
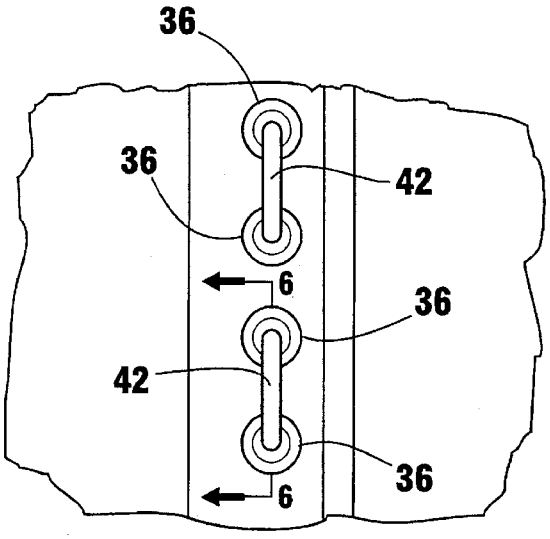
FIG. 5 is a partial top plan view taken along line 5—5 of FIG. 4.
Figure 6:
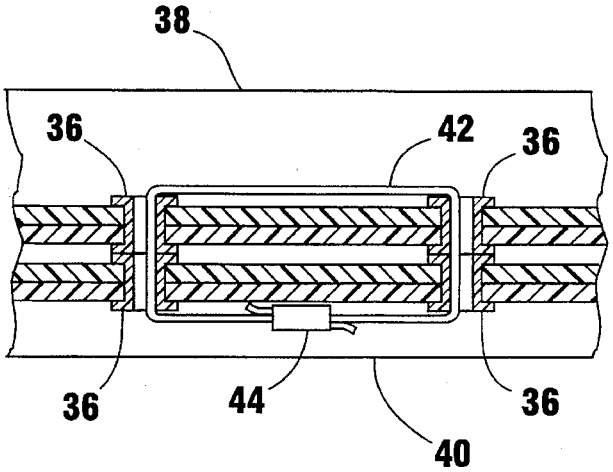
FIG. 6 is a sectional view taken along line 6—6 of FIG. 5.

The panels are joined together by a plurality of panel ties 42 (FIGS. 5 and 6). First the flattened edges 28, 30 of each panel are overlapped with the flattened edges 28, 30 of the adjacent panels and the grommets 36 are placed in registered alignment as shown in FIG. 6. Then the panel tie members 42 are passed through to adjacent pairs of grommets 36 as shown in FIG. 6, with the loose ends of the tie members 42 being joined together by a conventional tie lock 44. Any conventional tie lock may be used to join the two ends together. It is preferred that the tie members also be formed from an acid, corrosion, and chemical resistant material as well as an ultra-violet resistant material. Examples of the preferred material for the cables are a plastic cable tie sold under the TM TY-RAP, manufactured by Thomas & Betts, Electrical Components Division, having an address of 1555 Lynnfield Rd., Memphis, Tenn. 38119.

While the grommets 36 may be formed from metal or other materials, it is preferred that they be formed of a plastic material which is acid resistant, chemical resistant, and corrosion resistant, and ultra-violet light resistant.

Figure 1:
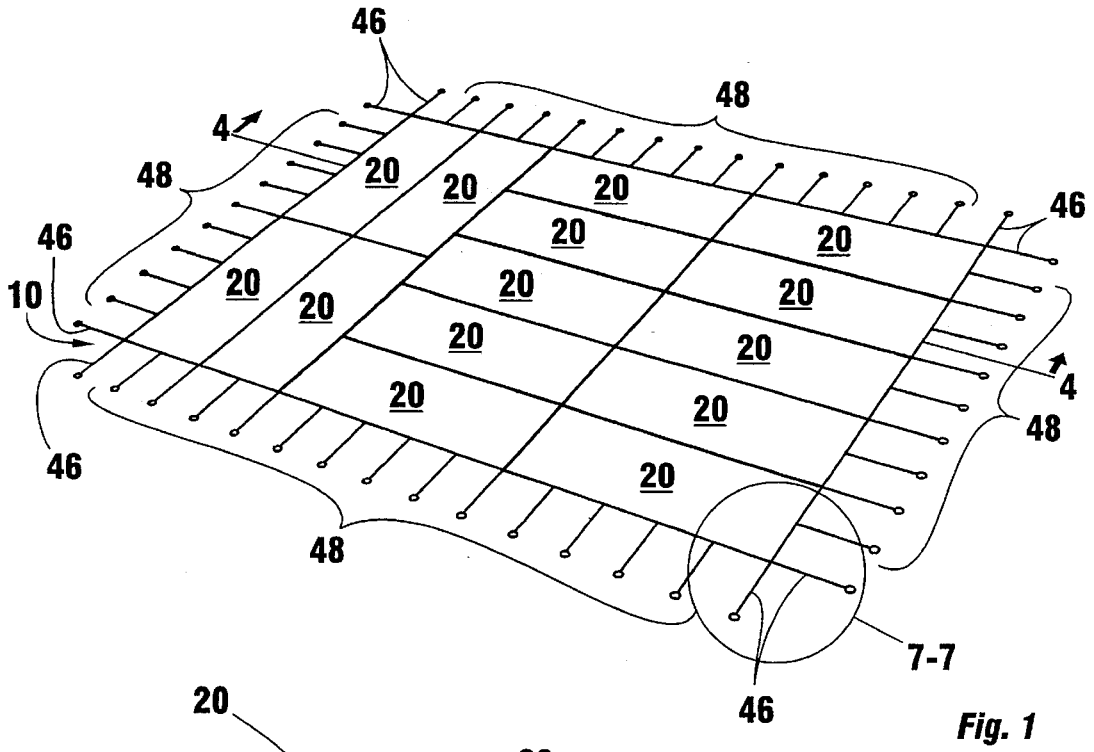
FIG. 1 is a pictorial view of the panel assembly of the present invention positioned in covering relation over a lagoon.
Figure 2:
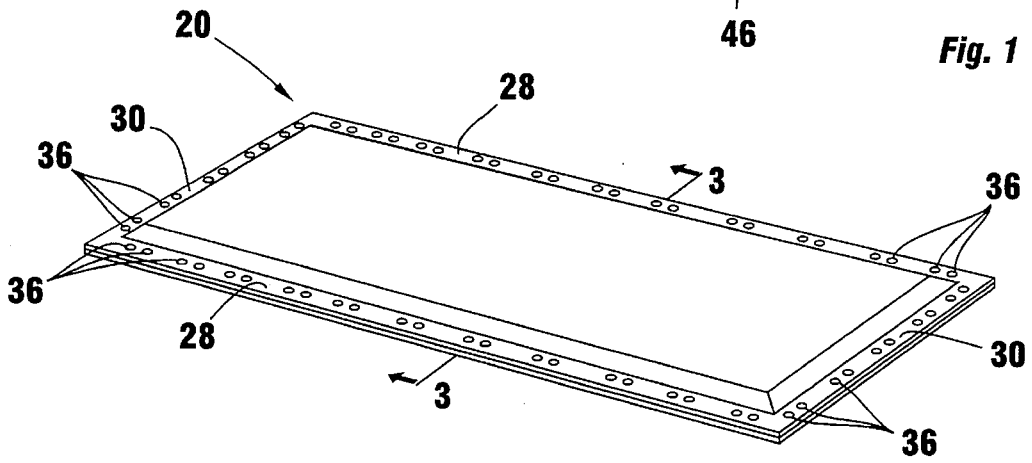
FIG. 2 is a pictorial view of one of the panels which are assembled into the panel assembly of FIG. 1.

As can be seen in FIG. 1, the panels 20 may be assembled in a variety of configurations. They may be assembled side to side, end to side or end to end depending upon the desired configuration needed to cover the particular lagoon or pool.

Figure 7:
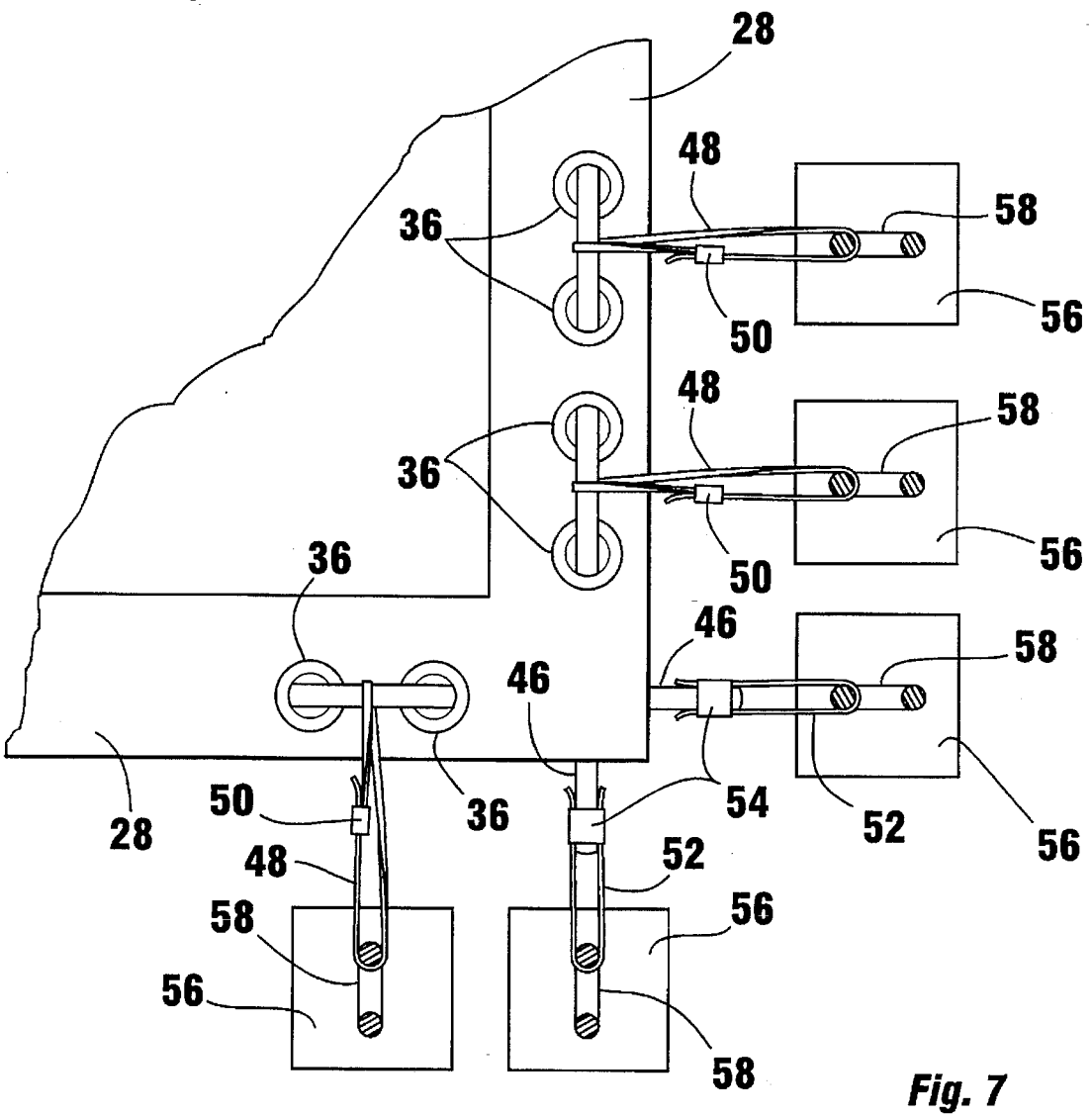
FIG. 7 is an enlarged plan view taken along line 7—7 of FIG. 1.

Referring to FIG. 7, a plurality of edge rods 46 are threaded through the grommets 36 along the edges of the panel assembly 10. These edge rods are preferably a polypropylene cord, either ¼ inch or ⅛ inch diameter, manufactured under product numbers 3837T35 and 3837T33, respectively, by McMaster-Carr Supply Company, P.O. Box 4355, Chicago, Ill. 60680. A plurality of anchor ties 48 are looped around the rods 46 at spaced positions around the periphery of the panel assembly. Each of the anchor ties 48 then extend through an eyelet 58 in an anchor 56 positioned around the perimeter of the pool or lagoon. The ends of the anchor ties are joined by a tie lock 50.

The opposite ends of each of the edge rods 46 are connected to anchors 56 by means of corner anchor ties 52 which loop through one of the eyelet's 58 and are joined to the end of the edge rod 46 by means of a tie lock 50.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. An insulated cover for a pool having a pool perimeter, a pool bottom, and a quantity of fluid contained therein, said cover comprising:

a plurality of panels having perimetric panel edges, each of said panels comprising first and second sheet members each having perimetric sheet edges, said first and second sheet members being superimposed in registered relation with one another and having their respective perimetric sheet edges joined together to create a pocket therebetween, and an insulative material enclosed within said pocket;

a plurality of panel tie members joining said plurality of panels together in edge to edge relation so as to create a panel assembly having a perimetric assembly edge;

a plurality of anchors adapted to be positioned around said pool;

a plurality of elongated plastic members made of corrosion and acid resistant material extending along and retentively engaging said assembly edge of said panel assembly;

a plurality of anchor tie members, each connected to one of said elongated plastic members and to one of said anchors to secure said panel assembly in covering relation over said fluid within said pool.

2. An insulated cover according to claim 1 wherein each of said plastic members include opposite ends, each of said opposite ends being connected to one of said anchors.

3. An insulated cover according to claim 2 wherein a plurality of grommets are mounted in spaced relation along said perimetric assembly edge, said plastic members each extending through at least some of said grommets.

4. An insulated cover according to claim 3 wherein said panels, said panel ties, said anchor tie members, said plastic members, and said grommets are all made of plastic which is acid and corrosion resistant.

5. An insulating cover according to claim 1 wherein said first and second sheet members are made of plastic and said perimetric panel edges of said first and second sheet members are fusion welded together.

6. A method for providing an insulated cover over a pool having a pool perimeter, a pool bottom, and a quantity of fluid contained therein, said method comprising:

assembling a plurality of insulated panels together in edge to edge relationship to form a panel assembly having a perimetric assembly edge, each of said panels comprising first and second sheet members having perimetric sheet edges joined together to form a pocket therebetween, an insulative material being enclosed within said pocket; said perimetric assembly edge of said panel assembly including a plurality of spaced apart grommets thereon;

using a plurality of panel tie members to secure the adjacent edges of said insulated panels together;

extending an elongated plastic member through at least some of said grommets;

positioning said panel assembly in covering relation over said pool; and connecting a plurality of anchor tie members to said panel assembly by connecting each of said anchor tie members to one of a plurality of anchors positioned around said pool perimeter and to at least one of said elongated plastic members.

7. An insulated cover for a pool having a pool perimeter, a pool bottom, and a quantity of fluid contained therein, said cover comprising:

a plurality of panels having perimetric panel edges, each of said panels comprising first and second members each having perimetric sheet edges, said first and second sheet members being superimposed in registered relation with one another and having the respective perimetric sheet edges joined together to create a pocket therebetween, and an insulative material enclosed within said pocket;

a plurality of spaced apart grommets mounted on each of said panels along said perimetric panel edges;

said panels overlapping one another such that said grommets along one of said perimetric panel edges on one of said panels register with said grommets along one of said perimetric panel edges on an overlapping panel;

a plurality of panel tie members each extending through both a first pair of said grommets on said one panel and a second pair of said grommets registered therewith on said overlapping panel and thereafter being formed into a closed loop connecting both of said pairs of grommets thereby joining said plurality of panels together in edge to edge relation so as to create a panel assembly having a perimetric assembly edge;

a plurality of anchors adapted to be positioned around said pool;

a plurality of anchor tie members, each connected to said perimetric assembly edge and to one of said anchors to secure said panel assembly in covering relation over said fluid within said pool.

8. A method for providing an insulated cover over a pool having a pool perimeter, a pool bottom, and a quantity of fluid contained therein, said method comprising:

assembling a plurality of insulated panels having perimetric panel edges together in edge to edge relationship to form a panel assembly having a perimetric assembly edge, each of said panels comprising first and second sheet members having perimetric sheet edges joined together to form a pocket therebetween, an insulated material being enclosed within said pocket, a plurality of spaced apart grommets mounted on each of said panels along said perimetric panel edges;

overlapping said panels such that said grommets along one of said perimetric panel edges on one of said panels register with said grommets along one of said perimetric panel edges on an overlapping panel;

using a plurality of panel tie members to secure adjacent edges of said insulated panels together by extending one of said panel tie members through a first pair of said grommets on said one panel and a second pair of said grommets registered therewith on said overlapping panel and thereafter being formed into a closed loop connecting both of said pairs of grommets thereby joining said plurality of panels together in edge to edge relation so as to create said panel assembly having said perimetric assembly edge;

connecting a plurality of anchor tie members to said perimetric assembly edge of said panel assembly;

positioning said panel assembly in covering relation over said pool; and connecting each of said anchor tie members to one of a plurality of anchors positioned around said pool perimeter.

9. A method according to claim 8 wherein said perimetric assembly edge of said panel assembly has mounted thereon some of said plurality of spaced apart grommets, said step of connecting said anchor tie members to said perimetric assembly edge of said panel assembly being accomplished by extending each of said anchor tie members around an elongated plastic member extending through said grommets.

10. A method according to claim 8 wherein said perimetric assembly edge of said panel assembly includes some of said plurality of spaced apart grommets, said method further comprising extending an elongated plastic member through at least some of said grommets and said step of connecting said anchor tie members to said perimetric assembly edge including connecting said anchor tie members to said elongated plastic member.

* * * * *